US007540593B2

(12) United States Patent
Hock et al.

(10) Patent No.: US 7,540,593 B2
(45) Date of Patent: Jun. 2, 2009

(54) FLUID EJECTION ASSEMBLY

(75) Inventors: Scott W. Hock, Poway, CA (US); Paul Crivelli, San Diego, CA (US); Hector Jose Lebron, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 445 days.

(21) Appl. No.: 11/114,961

(22) Filed: Apr. 26, 2005

(65) Prior Publication Data

US 2006/0238577 A1 Oct. 26, 2006

(51) Int. Cl.
*B41J 2/05* (2006.01)

(52) U.S. Cl. ..... 347/65

(58) Field of Classification Search ..... 347/12–13, 347/65, 71, 20, 54, 56
See application file for complete search history.

(56) References Cited

U.S. PATENT DOCUMENTS

| | | | | |
|---|---|---|---|---|
| 4,007,464 | A | 2/1977 | Bassous et al. | |
| 4,412,224 | A | 10/1983 | Sugitani | |
| 4,438,191 | A | 3/1984 | Cloutier et al. | |
| 4,455,560 | A | 6/1984 | Louzil | |
| 4,567,493 | A | 1/1986 | Ikeda et al. | |
| 4,596,994 | A | 6/1986 | Matsuda et al. | |
| 4,611,219 | A | 9/1986 | Sugitani et al. | |
| 4,646,110 | A | 2/1987 | Ikeda et al. | |
| 4,680,595 | A | 7/1987 | Cruz-Uribe et al. | |
| 4,695,854 | A | 9/1987 | Cruz-Uribe | |
| 4,730,197 | A | 3/1988 | Raman et al. | |
| 4,777,494 | A | 10/1988 | Shibata et al. | |
| 4,823,149 | A | 4/1989 | Martner et al. | |
| 4,894,664 | A | 1/1990 | Tsung Pan | |
| 4,897,668 | A | 1/1990 | Nagato et al. | |
| 4,905,017 | A | 2/1990 | Sugitani et al. | |
| 4,929,964 | A | 5/1990 | Sato et al. | |
| 4,965,594 | A | 10/1990 | Komuro | |
| 5,068,674 | A | 11/1991 | Sato et al. | |
| 5,132,707 | A | 7/1992 | O'Neill | |
| 5,163,177 | A * | 11/1992 | Komura | 347/64 |
| 5,165,061 | A | 11/1992 | Witteveen | |
| 5,469,199 | A | 11/1995 | Allen et al. | |
| 5,565,900 | A | 10/1996 | Cowger et al. | |
| 5,592,203 | A | 1/1997 | Thiel et al. | |
| 5,604,519 | A | 2/1997 | Keefe et al. | |
| 5,610,641 | A | 3/1997 | Ikado | |

(Continued)

FOREIGN PATENT DOCUMENTS

| | | |
|---|---|---|
| EP | 0067653 | 12/1982 |

(Continued)

OTHER PUBLICATIONS

WO Search Report-PCT/US2004/020677, Jun. 2004, HP.

*Primary Examiner*—Matthew Luu
*Assistant Examiner*—Lisa M Solomon

(57) ABSTRACT

A fluid ejection assembly includes a first layer, and a second layer positioned on a side of the first layer. The second layer has a side adjacent the side of the first layer and includes a drop ejecting element formed on the side and a fluid pathway communicated with the drop ejecting element. The first layer and the fluid pathway of the second layer form a nozzle, and the nozzle has a cross-shaped cross-section.

37 Claims, 9 Drawing Sheets

U.S. PATENT DOCUMENTS

| | | | | |
|---|---|---|---|---|
| 5,748,214 | A | 5/1998 | Usui et al. | |
| 5,752,303 | A | 5/1998 | Thiel | |
| 5,802,687 | A | 9/1998 | Thiel et al. | |
| 5,818,479 | A | 10/1998 | Reinecke et al. | |
| 5,825,382 | A | 10/1998 | Thiel | |
| 5,880,756 | A | 3/1999 | Ishii et al. | |
| 5,883,651 | A | 3/1999 | Thiel et al. | |
| 5,956,059 | A | 9/1999 | Usui | |
| 5,969,736 | A | 10/1999 | Field et al. | |
| 6,024,440 | A | 2/2000 | Murthy et al. | |
| 6,044,646 | A | 4/2000 | Silverbrook | |
| 6,135,586 | A | 10/2000 | McClelland et al. | |
| 6,155,674 | A | 12/2000 | Figueredo et al. | |
| 6,203,145 | B1 | 3/2001 | Jeanmaire et al. | |
| 6,206,501 | B1 | 3/2001 | Ishii et al. | |
| 6,209,991 | B1 | 4/2001 | Regan et al. | |
| 6,281,912 | B1 | 8/2001 | Silverbrook | |
| 6,286,939 | B1 | 9/2001 | Hindman et al. | |
| 6,328,428 | B1 | 12/2001 | Keefe et al. | |
| 6,367,911 | B1 | 4/2002 | Windel et al. | |
| 6,378,991 | B1 | 4/2002 | Lim et al. | |
| 6,409,323 | B1 | 6/2002 | Silverbrook | |
| 6,457,796 | B1 | 10/2002 | Fujii | |
| 6,471,339 | B1 | 10/2002 | Kamiyama et al. | |
| 6,739,519 | B2 * | 5/2004 | Stout et al. | 239/102.2 |
| 2004/0051757 | A1 | 3/2004 | Holland | |
| 2004/0125168 | A1 | 7/2004 | Eguchi | |
| 2005/0001886 | A1 * | 1/2005 | Hock et al. | 347/71 |

FOREIGN PATENT DOCUMENTS

| | | |
|---|---|---|
| EP | 0636481 | 2/1995 |
| EP | 1024008 | 5/2000 |
| EP | 1125745 | 8/2001 |

* cited by examiner

FLUID EJECTION ASSEMBLY

CROSS-REFERENCE TO RELATED APPLICATIONS

This application is related to U.S. patent application Ser. No. 10/613,471, filed on Jul. 3, 2003, assigned to the assignee of the present invention, and incorporated herein by reference.

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

SUMMARY

One aspect of the present invention provides a fluid ejection assembly. The fluid ejection assembly includes a first layer, and a second layer positioned on a side of the first layer. The second layer has a side adjacent the side of the first layer and includes a drop ejecting element formed on the side and a fluid pathway communicated with the drop ejecting element. The first layer and the fluid pathway of the second layer form a nozzle, and the nozzle has a cross-shaped cross-section.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
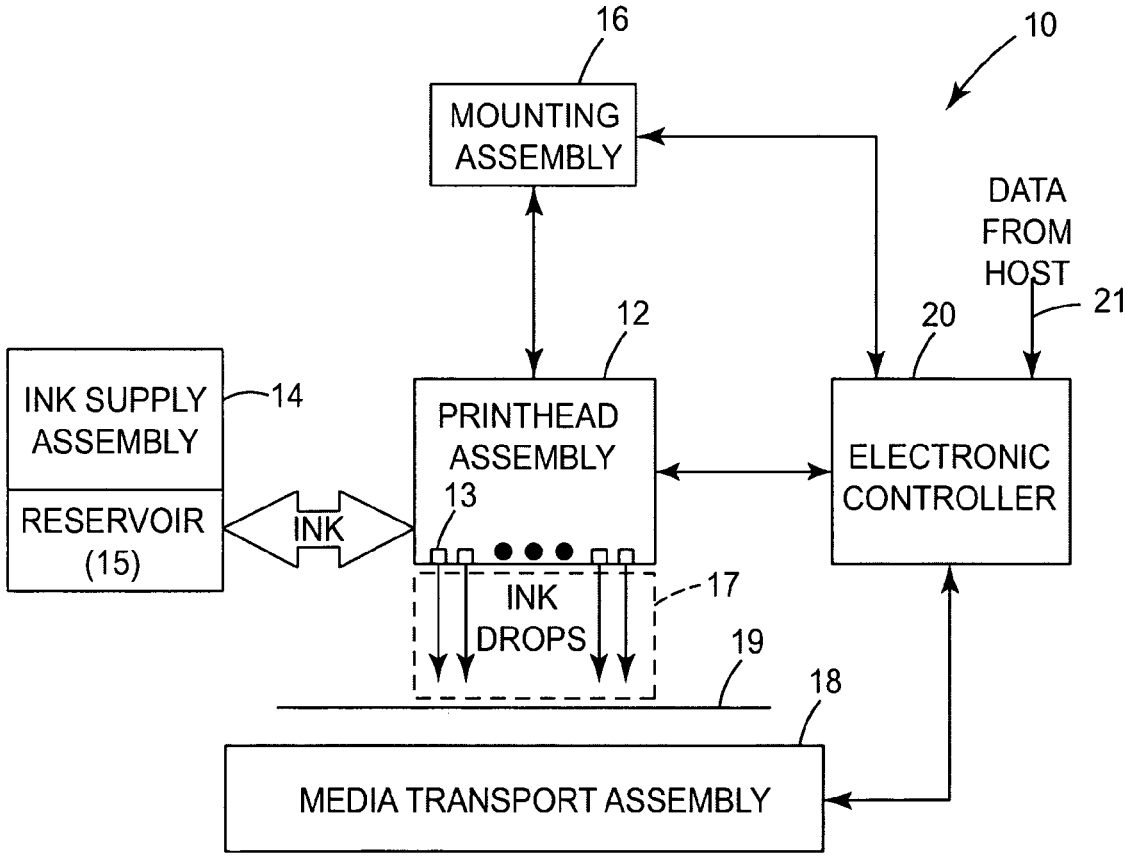
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as a printhead assembly 12, and a fluid supply assembly, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection assembly, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials, including clear fluid, may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes any type of suitable sheet material, such as paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply assembly, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube.

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other data or wireless data transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located off printhead assembly 12.

Figure 2:
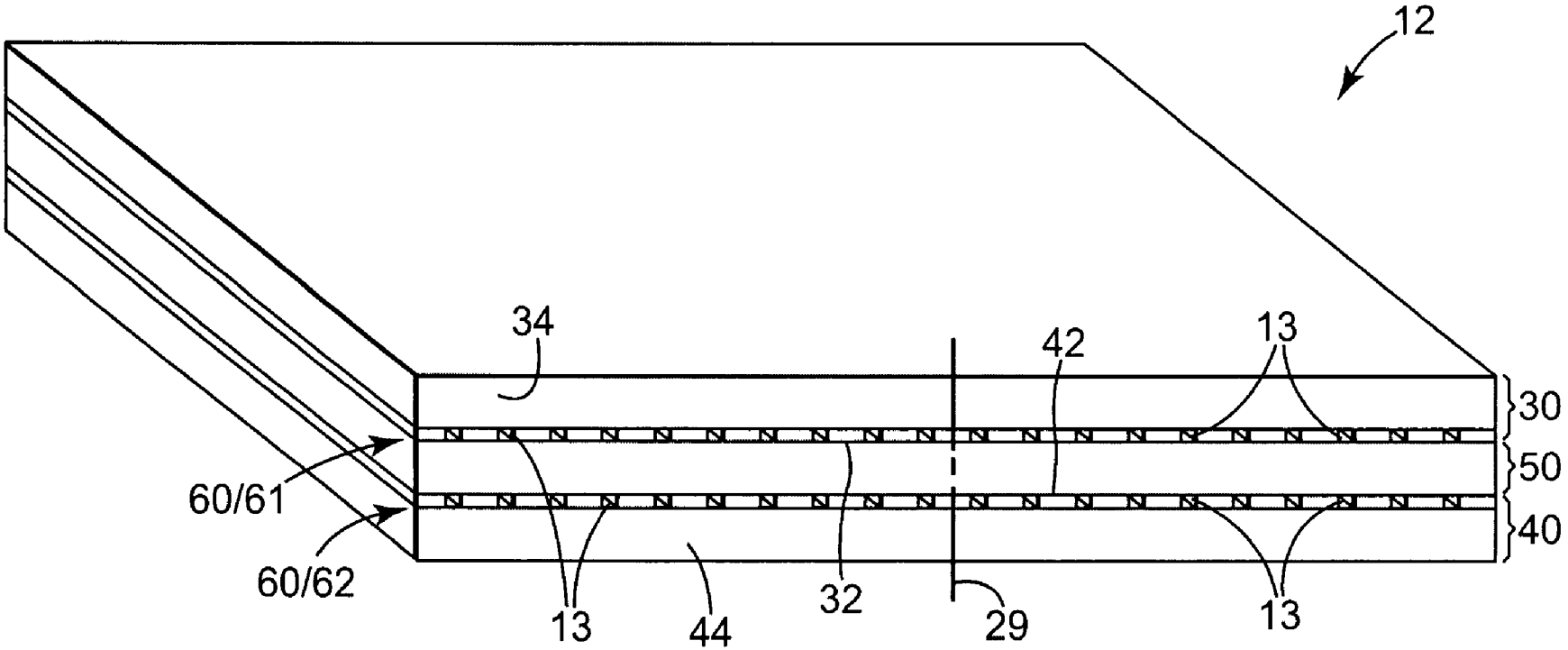
FIG. 2 is a schematic perspective view illustrating one embodiment of a printhead assembly according to the present invention.

FIG. 2 illustrates one embodiment of a portion of printhead assembly 12. In one embodiment, printhead assembly 12 is a multi-layered assembly and includes outer layers 30 and 40, and at least one inner layer 50. Outer layers 30 and 40 have a face or side 32 and 42, respectively, and an edge 34 and 44, respectively, contiguous with the respective side 32 and 42. Outer layers 30 and 40 are positioned on opposite sides of inner layer 50 such that sides 32 and 42 face inner layer 50 and are adjacent inner layer 50. As such, inner layer 50 and outer layers 30 and 40 are stacked along an axis 29.

As illustrated in the embodiment of FIG. 2, inner layer 50 and outer layers 30 and 40 are arranged to form one or more rows 60 of nozzles 13. Rows 60 of nozzles 13 extend, for example, in a direction substantially perpendicular to axis 29. As such, in one embodiment, axis 29 represents a print axis or axis of relative movement between printhead assembly 12 and print media 19. Thus, a length of rows 60 of nozzles 13 establishes a swath height of a swath printed on print media 19 by printhead assembly 12. In one exemplary embodiment, rows 60 of nozzles 13 span a distance less than approximately two inches. In another exemplary embodiment, rows 60 of nozzles 13 span a distance greater than approximately two inches.

In one exemplary embodiment, inner layer 50 and outer layers 30 and 40 form two rows 61 and 62 of nozzles 13. More specifically, inner layer 50 and outer layer 30 form row 61 of nozzles 13 along edge 34 of outer layer 30, and inner layer 50 and outer layer 40 form row 62 of nozzles 13 along edge 44 of outer layer 40. As such, in one embodiment, rows 61 and 62 of nozzles 13 are spaced from and oriented substantially parallel to each other.

In one embodiment, as illustrated in FIG. 2, nozzles 13 of rows 61 and 62 are substantially aligned. More specifically, each nozzle 13 of row 61 is substantially aligned with one nozzle 13 of row 62 along a print line oriented substantially parallel to axis 29. As such, the embodiment of FIG. 2 provides nozzle redundancy since fluid (or ink) can be ejected through multiple nozzles along a given print line. Thus, a defective or inoperative nozzle can be compensated for by another aligned nozzle. In addition, nozzle redundancy provides the ability to alternate nozzle activation amongst aligned nozzles.

Figure 3:
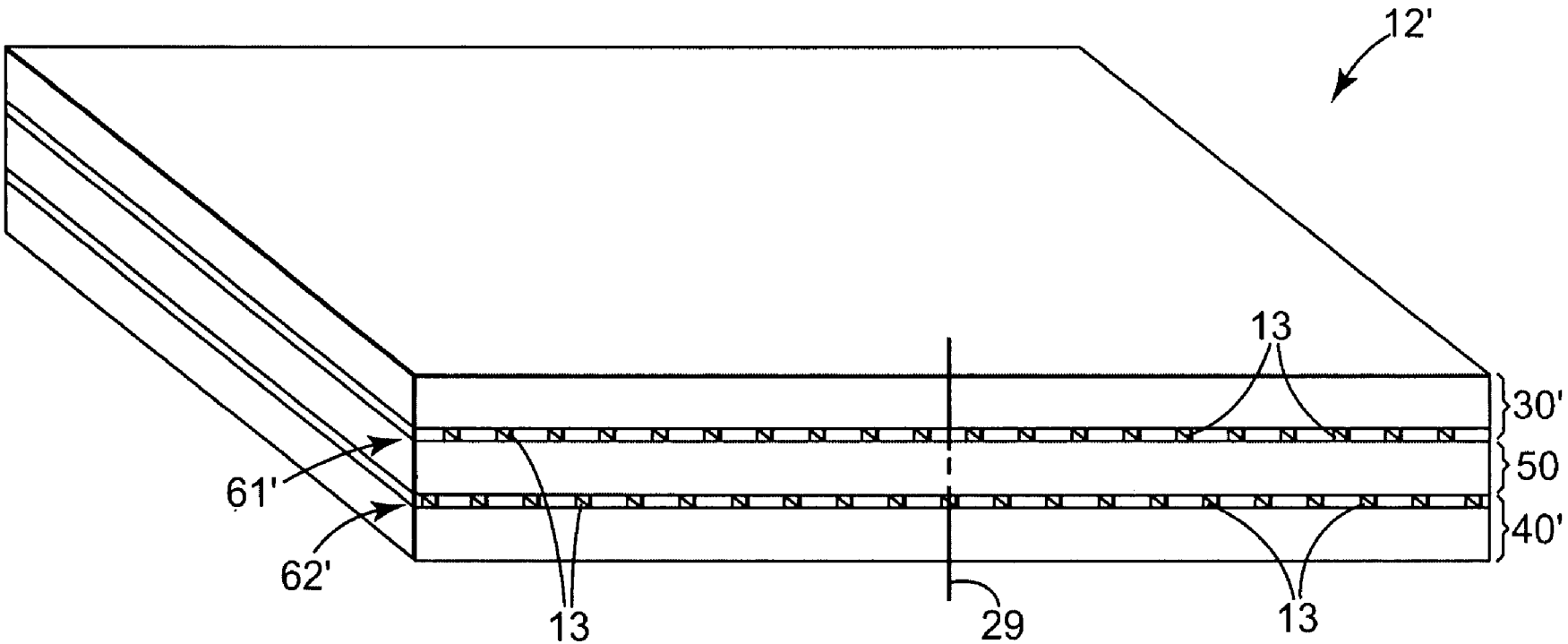
FIG. 3 is a schematic perspective view illustrating another embodiment of the printhead assembly of FIG. 2.

FIG. 3 illustrates another embodiment of a portion of printhead assembly 12. Similar to printhead assembly 12, printhead assembly 12' is a multi-layered assembly and includes outer layers 30' and 40', and inner layer 50. In addition, similar to outer layers 30 and 40, outer layers 30' and 40' are positioned on opposite sides of inner layer 50. As such, inner layer 50 and outer layers 30' and 40' form two rows 61' and 62' of nozzles 13.

As illustrated in the embodiment of FIG. 3, nozzles 13 of rows 61' and 62' are offset. More specifically, each nozzle 13 of row 61' is staggered or offset from one nozzle 13 of row 62' along a print line oriented substantially parallel to axis 29. As such, the embodiment of FIG. 3 provides increased resolution since the number of dots per inch (dpi) that can be printed along a line oriented substantially perpendicular to axis 29 is increased.

Figure 4:
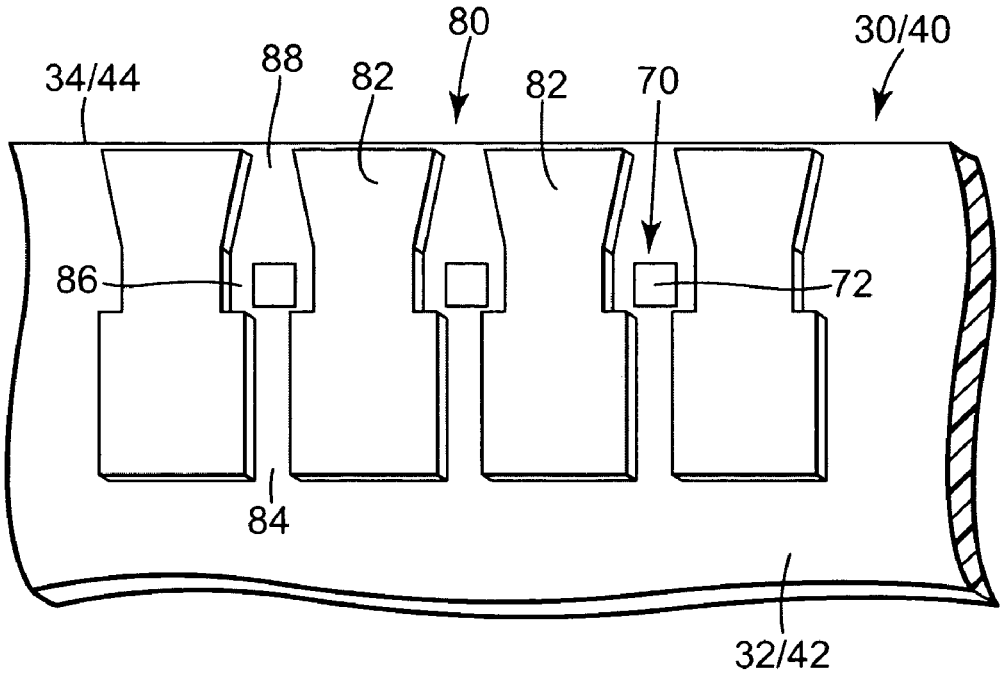
FIG. 4 is a schematic perspective view illustrating one embodiment of a portion of an outer layer of the printhead assembly of FIG. 2.

In one embodiment, as illustrated in FIG. 4, outer layers 30 and 40 (only one of which is illustrated in FIG. 4 and including outer layers 30' and 40') each include drop ejecting elements 70 and fluid pathways 80 formed on sides 32 and 42, respectively. Drop ejecting elements 70 and fluid pathways 80 are arranged such that fluid pathways 80 communicate with and supply fluid (or ink) to drop ejecting elements 70. In one embodiment, drop ejecting elements 70 and fluid pathways 80 are arranged in substantially linear arrays on sides 32 and 42 of respective outer layers 30 and 40. As such, all drop ejecting elements 70 and fluid pathways 80 of outer layer 30 are formed on a single or monolithic layer, and all drop ejecting elements 70 and fluid pathways 80 of outer layer 40 are formed on a single or monolithic layer.

In one embodiment, as described below, inner layer 50 (FIG. 2) has a fluid manifold or fluid passage defined therein which distributes fluid supplied, for example, by ink supply assembly 14 to fluid pathways 80 and drop ejecting elements 70 formed on outer layers 30 and 40.

In one embodiment, fluid pathways 80 are defined by barriers 82 formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50.

As illustrated in the embodiment of FIG. 4, each fluid pathway 80 includes a fluid inlet 84, a fluid chamber 86, and a fluid outlet 88 such that fluid chamber 86 communicates with fluid inlet 84 and fluid outlet 88. Fluid inlet 84 communicates with a supply of fluid (or ink), as described below, and supplies fluid (or ink) to fluid chamber 86. Fluid outlet 88 communicates with fluid chamber 86 and, in one embodiment, forms a portion of a respective nozzle 13 when outer layers 30 and 40 are positioned on opposite sides of inner layer 50.

In one embodiment, each drop ejecting element 70 includes a firing resistor 72 formed within fluid chamber 86 of a respective fluid pathway 80. Firing resistor 72 includes, for example, a heater resistor which, when energized, heats fluid within fluid chamber 86 to produce a bubble within fluid chamber 86 and generate a droplet of fluid which is ejected through nozzle 13. As such, in one embodiment, a respective fluid chamber 86, firing resistor 72, and nozzle 13 form a drop generator of a respective drop ejecting element 70.

In one embodiment, during operation, fluid flows from fluid inlet 84 to fluid chamber 86 where droplets of fluid are ejected from fluid chamber 86 through fluid outlet 88 and a respective nozzle 13 upon activation of a respective firing resistor 72. As such, droplets of fluid are ejected substantially parallel to sides 32 and 42 of respective outer layers 30 and 40 toward a medium. Accordingly, in one embodiment, printhead assembly 12 constitutes an edge or "side-shooter" design.

Figure 5:
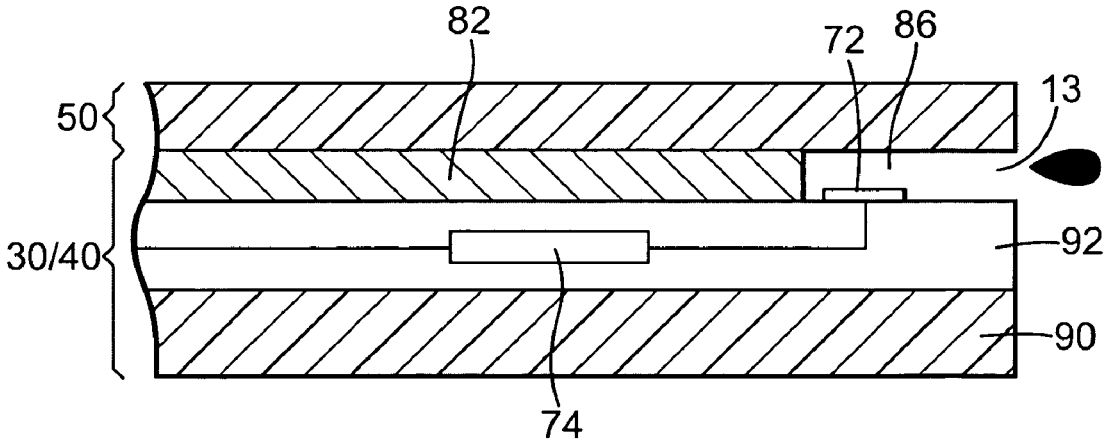
FIG. 5 is a schematic cross-sectional view illustrating one embodiment of a portion of the printhead assembly of FIG. 2.

In one embodiment, as illustrated in FIG. 5, outer layers 30 and 40 (only one of which is illustrated in FIG. 5 and including outer layers 30' and 40') each include a substrate 90 and a thin-film structure 92 formed on substrate 90. As such, firing resistors 72 of drop ejecting elements 70 and barriers 82 of fluid pathways 80 are formed on thin-film structure 92. As described above, outer layers 30 and 40 are positioned on opposite sides of inner layer 50 to form fluid chamber 86 and nozzle 13 of a respective drop ejecting element 70.

In one embodiment, inner layer 50 and substrate 90 of outer layers 30 and 40 each include a common material. As such, a coefficient of thermal expansion of inner layer 50 and outer layers 30 and 40 is substantially matched. Thus, thermal gradients between inner layer 50 and outer layers 30 and 40 are minimized. Example materials suitable for inner layer 50 and substrate 90 of outer layers 30 and 40 include glass, metal, a ceramic material, a carbon composite material, a metal matrix composite material, or any other chemically inert and thermally stable material.

In one exemplary embodiment, inner layer 50 and substrate 90 of outer layers 30 and 40 include glass such as Corning® 1737 glass or Corning® 1740 glass. In one exemplary embodiment, when inner layer 50 and substrate 90 of outer layers 30 and 40 include a metal or metal matrix composite material, an oxide layer is formed on the metal or metal matrix composite material of substrate 90.

In one embodiment, thin-film structure 92 includes drive circuitry 74 for drop ejecting elements 70. Drive circuitry 74 provides, for example, power, ground, and logic for drop ejecting elements 70 including, more specifically, firing resistors 72.

In one embodiment, thin-film structure 92 includes one or more passivation or insulation layers formed, for example, of silicon dioxide, silicon carbide, silicon nitride, tantalum, poly-silicon glass, or other suitable material. In addition, thin-film structure 92 also includes one or more conductive layers formed, for example, by aluminum, gold, tantalum, tantalum-aluminum, or other metal or metal alloy. In one embodiment, thin-film structure 92 includes thin-film transistors which form a portion of drive circuitry 74 for drop ejecting elements 70.

As illustrated in the embodiment of FIG. 5, barriers 82 of fluid pathways 80 are formed on thin-film structure 92. In one embodiment, barriers 82 are formed of a non-conductive material compatible with the fluid (or ink) to be routed through and ejected from printhead assembly 12. Example materials suitable for barriers 82 include a photo-imageable polymer and glass. The photo-imageable polymer may include a spun-on material, such as SU8, or a dry-film material, such as DuPont Vacrel®.

As illustrated in the embodiment of FIG. 5, outer layers 30 and 40 (including outer layers 30' and 40') are joined to inner layer 50 at barriers 82. In one embodiment, when barriers 82 are formed of a photo-imageable polymer or glass, outer layers 30 and 40 are bonded to inner layer 50 by temperature and pressure. Other suitable joining or bonding techniques, however, can also be used to join outer layers 30 and 40 to inner layer 50.

Figure 6:
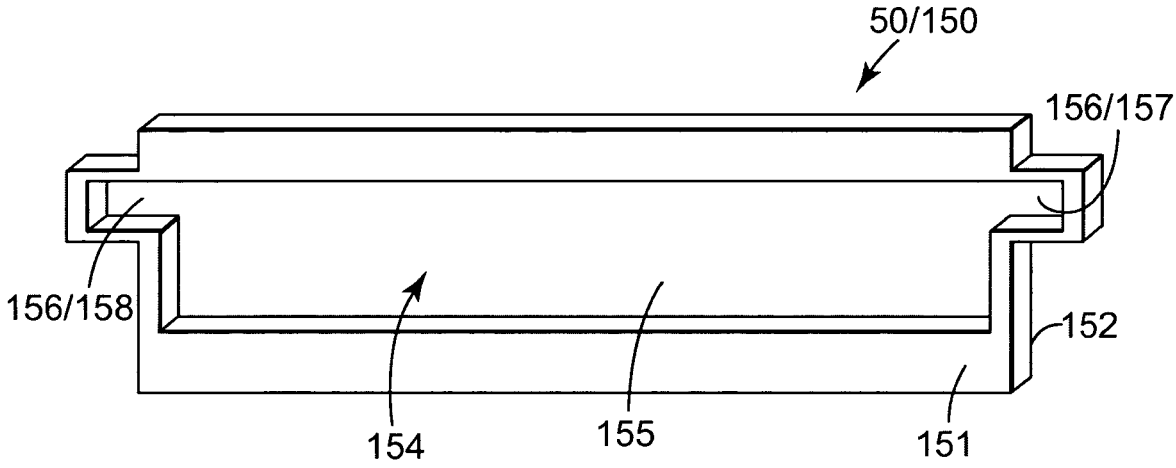
FIG. 6 is a schematic plan view illustrating one embodiment of an inner layer of the printhead assembly of FIG. 2.

In one embodiment, as illustrated in FIG. 6, inner layer 50 includes a single inner layer 150. Single inner layer 150 has a first side 151 and a second side 152 opposite first side 151. In one embodiment, side 32 (FIG. 4) of outer layer 30 is adjacent first side 151 and side 42 of outer layer 40 is adjacent second side 152 when outer layers 30 and 40 are positioned on opposite sides of inner layer 50.

In one embodiment, single inner layer 150 has a fluid passage 154 defined therein. Fluid passage 154 includes, for example, an opening 155 which communicates with first side 151 and second side 152 of single inner layer 150 and extends between opposite ends of single inner layer 150. As such, fluid passage 154 distributes fluid through single inner layer 150 and to fluid pathways 80 of outer layers 30 and 40 when outer layers 30 and 40 are positioned on opposite sides of single inner layer 150.

As illustrated in the embodiment of FIG. 6, single inner layer 150 includes at least one fluid port 156. In one exemplary embodiment, single inner layer 150 includes fluid ports 157 and 158 each communicating with fluid passage 154. In one embodiment, fluid ports 157 and 158 form a fluid inlet and a fluid outlet for fluid passage 154. As such, fluid ports 157 and 158 communicate with ink supply assembly 14 (FIG. 1) and enable circulation of fluid (or ink) between ink supply assembly 14 and printhead assembly 12.

Figure 7:
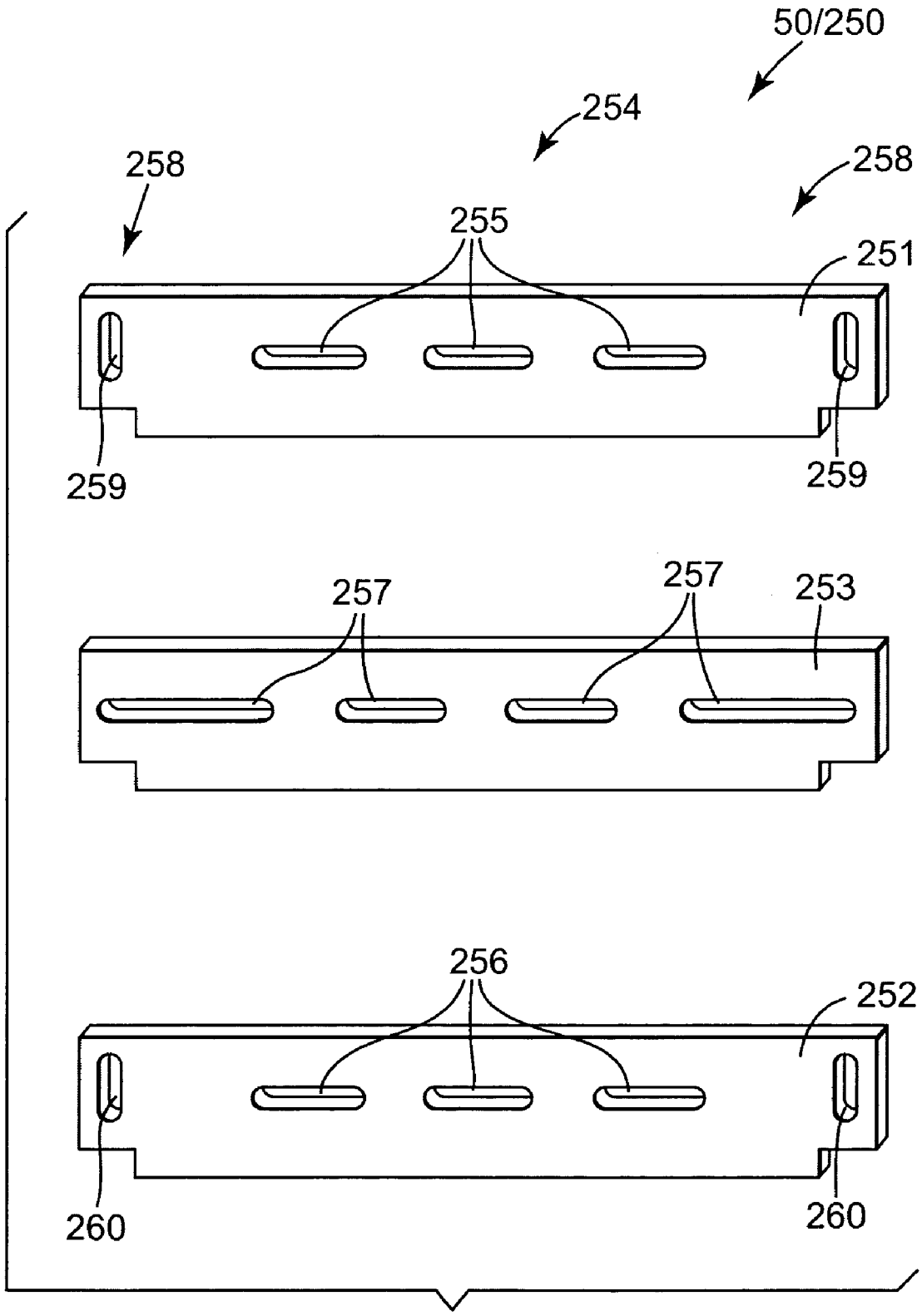
FIG. 7 is a schematic plan view illustrating another embodiment of an inner layer of the printhead assembly of FIG. 2.

In another embodiment, as illustrated in FIG. 7, inner layer 50 includes a plurality of inner layers 250. In one exemplary embodiment, inner layers 250 include inner layers 251, 252, and 253 such that inner layer 253 is interposed between inner layers 251 and 252. As such, side 32 of outer layer 30 is adjacent inner layer 251 and side 42 of outer layer 40 is adjacent inner layer 252 when outer layers 30 and 40 are positioned on opposite sides of inner layers 250.

In one exemplary embodiment, inner layers 251, 252, and 253 are joined together by glass frit bonding. As such, glass frit material is deposited and patterned on inner layers 251, 252, and/or 253, and inner layers 251, 252, and 253 are bonded together under temperature and pressure. Thus, joints between inner layers 251, 252, and 253 are thermally matched. In another exemplary embodiment, inner layers 251, 252, and 253 are joined together by anodic bonding. As such, inner layers 251, 252, and 253 are brought into intimate contact and a voltage is applied across the layers. Thus, joints between inner layers 251, 252, and 253 are thermally matched and chemically inert since no additional material is used. In another exemplary embodiment, inner layers 251, 252, and 253 are joined together by adhesive bonding. Other suitable joining or bonding techniques, however, can also be used to join inner layers 251, 252, and 253.

In one embodiment, inner layers 250 have a fluid manifold or fluid passage 254 defined therein. Fluid passage 254 includes, for example, openings 255 formed in inner layer 251, openings 256 formed in inner layer 252, and openings 257 formed in inner layer 253. Openings 255, 256, and 257 are formed and arranged such that openings 257 of inner layer 253 communicate with openings 255 and 256 of inner layers 251 and 252, respectively, when inner layer 253 is interposed between inner layers 251 and 252. As such, fluid passage 254 distributes fluid through inner layers 250 and to fluid pathways 80 of outer layers 30 and 40 when outer layers 30 and 40 are positioned on opposite sides of inner layers 250.

As illustrated in the embodiment of FIG. 7, inner layers 250 include at least one fluid port 258. In one exemplary embodiment, inner layers 250 include fluid ports 259 and 260 each formed in inner layers 251 and 252. As such, fluid ports 259 and 260 communicate with openings 257 of inner layer 253 when inner layer 253 is interposed between inner layers 251 and 252. In one embodiment, fluid ports 259 and 260 form a fluid inlet and a fluid outlet for fluid passage 254. As such, fluid ports 259 and 260 communicate with ink supply assembly 14 and enable circulation of fluid (or ink) between ink supply assembly 14 and printhead assembly 12.

In one embodiment, by forming drop ejecting elements 70 and fluid pathways 80 on outer layers 30 and 40, and positioning outer layers 30 and 40 on opposite sides of inner layer 50, as described above, printhead assembly 12 can be formed of varying lengths. For example, printhead assembly 12 may span a nominal page width, or a width shorter or longer than nominal page width. In one exemplary embodiment, printhead assembly 12 is formed as a wide-array or page-wide array such that rows 61 and 62 of nozzles 13 span a nominal page width.

In one embodiment, as described above with reference to FIG. 4, fluid pathways 80 are defined by barriers 82 as formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50. Accordingly, in one embodiment, barriers 82 are formed on opposite sides of fluid pathways 80 and define a cross-sectional profile of nozzles 13.

Figure 8:
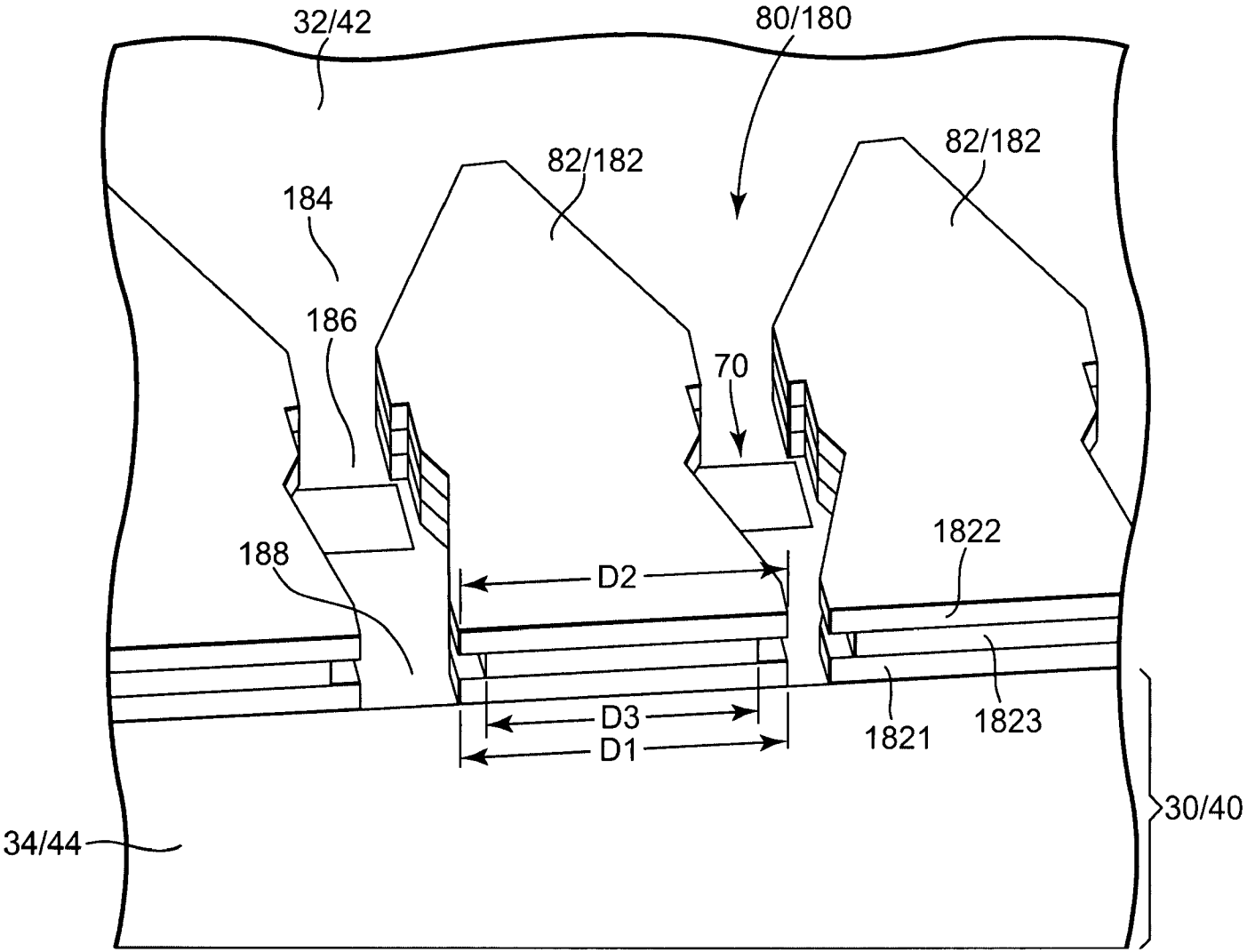
FIG. 8 is a schematic perspective view illustrating one embodiment of a portion of a printhead assembly.

In one embodiment, as illustrated in FIG. 8, fluid pathways 80 include fluid pathways 180 and barriers 82 include barriers 182. In one embodiment, barriers 182 include multi-layer barriers which are formed on opposite sides of fluid pathways 180. In addition, in one embodiment, barriers 182 define nozzles 13 as cross-shaped nozzles 130 (FIG. 9), as described below.

As illustrated in the embodiment of FIG. 8, barriers 182 each include a barrier layer 1821, a barrier layer 1822, and at least one barrier layer 1823 interposed between barrier layer 1821 and barrier layer 1822. In one embodiment, for example, barrier layer 1821 is formed on side 32 and/or 42 of a respective outer layer 30 and/or 40, barrier layer 1823 is formed on barrier layer 1821, and barrier layer 1822 is formed on barrier layer 1823. As such, barrier layer 1823 is interposed between barrier layer 1821 and barrier layer 1822. Although one barrier layer 1823 is illustrated and described as being interposed between barrier layers 1821 and 1822, it is within the scope of the present invention for one or more barrier layers 1823 to be interposed between barrier layers 1821 and 1822.

In one embodiment, similar to fluid pathways 80, fluid pathways 180 each include a fluid inlet 184, a fluid chamber 186, and a fluid outlet 188 such that fluid chamber 186 communicates with fluid inlet 184 and fluid outlet 188. Fluid inlet 184 communicates with a supply of fluid (or ink), as described above, and supplies fluid (or ink) to fluid chamber 186. Fluid outlet 188 communicates with fluid chamber 186 and, in one embodiment, forms a portion of a respective nozzle 130 (FIG. 9) when outer layer 30 and/or 40 is positioned on a respective side of inner layer 50. In one embodiment, drop ejecting elements 70, as described above, are formed within fluid chamber 186 of a respective fluid pathway 180.

In one embodiment, and with reference to FIG. 5, similar to barriers 82, barriers 182 are formed on thin-film structure 92 of outer layer 30 and/or 40. In one embodiment, barriers 182 are formed of a material compatible with the fluid (or ink) to be routed through and ejected from printhead assembly 12. Example materials suitable for barriers 182 include a non-conductive material such as a photo-imageable polymer or glass, or a conductive material such as a deposited metal. The photo-imageable polymer may include, for example, a spun-on material, such as SU8, or a dry-film material, such as DuPont Vacrel®, and the deposited metal may include, for example, nickel.

As illustrated in the embodiment of FIG. 8, barrier layer 1821 has a dimension D1 as defined along edge 34 and/or 44 of respective outer layer 30 and/or 40, barrier layer 1822 has a dimension D2 as defined along an edge parallel with edge 34 and/or 44, and barrier layer 1823 has a dimension D3 as defined along an edge parallel with edge 34 and/or 44. In one embodiment, dimension D1 of barrier layer 1821 and dimension D2 of barrier layer 1822 are substantially equal and dimension D3 of barrier layer 1823 is less than dimension D1 and dimension D2. As such, barrier layer 1823 is narrower than barrier layers 1821 and 1822 along edge 34 and/or 44.

In one embodiment, a profile of barrier layer 1823 narrows relative to barrier layers 1821 and 1822 in a region of fluid outlet 188 of fluid pathway 180. The profile of barrier layer 1823 in a region of fluid chamber 186 and fluid inlet 184 of fluid pathway 180, however, is substantially similar to that of barrier layers 1821 and 1822. Although barrier layers 1821, 1822, and 1823 are illustrated as having substantially equal thicknesses, it is within the scope of the present invention for barrier layers 1821, 1822, and/or 1823 to have different thicknesses. In addition, barrier layers 1821, 1822, and/or 1823 may be positioned flush with edge 34 or 44 of respective outer layer 30 or 40, recessed relative to edge 34 or 44 of respective outer layer 30 or 40, and/or protrude from edge 34 or 44 of respective outer layer 30 or 40.

In one embodiment, as illustrated in FIG. 8, barriers 182 are formed as separate features or "islands" on outer layers 30 and/or 40. By forming barriers 182 as separate features, the accumulation of shear stresses and the potential affects of a mismatch of the coefficient of thermal expansion of barriers 182 and outer layers 30 and/or 40, such as bending or deflection of the layers, is mitigated compared to barriers formed from a continuous layer of material due to the discontinuity of barriers 182.

Figure 9:
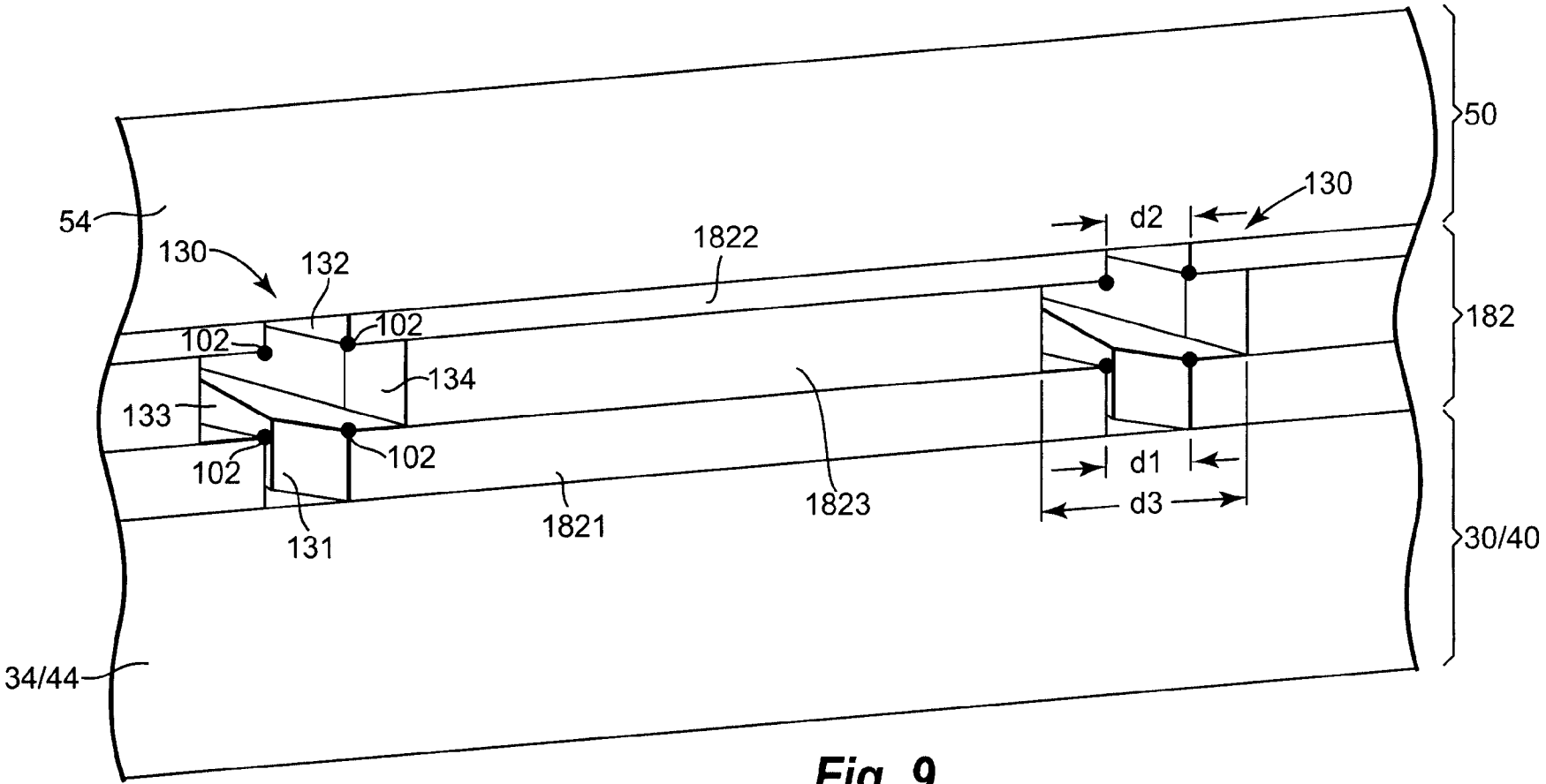
FIG. 9 is a schematic perspective view illustrating one embodiment of a nozzle for a printhead assembly.

As illustrated in the embodiment of FIG. 9, when outer layer 30 and/or 40 is joined to inner layer 50, as described above, outer layer 30 and/or 40, barriers 182 (including barrier layers 1821, 1822, and 1823), and inner layer 50 form and define nozzles 130. In one embodiment, as described above, nozzles 130 have a cross-shaped cross-section. As such, one arm 131 of the cross-shaped cross-section of each nozzle 130 is defined by outer layer 30 and/or 40 and barrier layer 1821, one arm 132 of the cross-shaped cross-section of each nozzle 130 is defined by inner layer 50 and barrier layer 1822, and two arms 133 and 134 of the cross-shaped cross-section of each nozzle 130 are defined by barrier layer 1823, and barrier layers 1821 and 1822.

In one embodiment, as illustrated in FIG. 9, nozzle 130 has a dimension d1 along edge 34 and/or 44 of respective outer layer 30 and/or 40, a dimension d2 along an edge 54 of inner layer 50, and a dimension d3 intermediate of and parallel with edge 34 and/or 44 and edge 54. With the cross-shaped cross-section of nozzle 130, dimension d1 and dimension d2 are each less than dimension d3.

Figure 10:
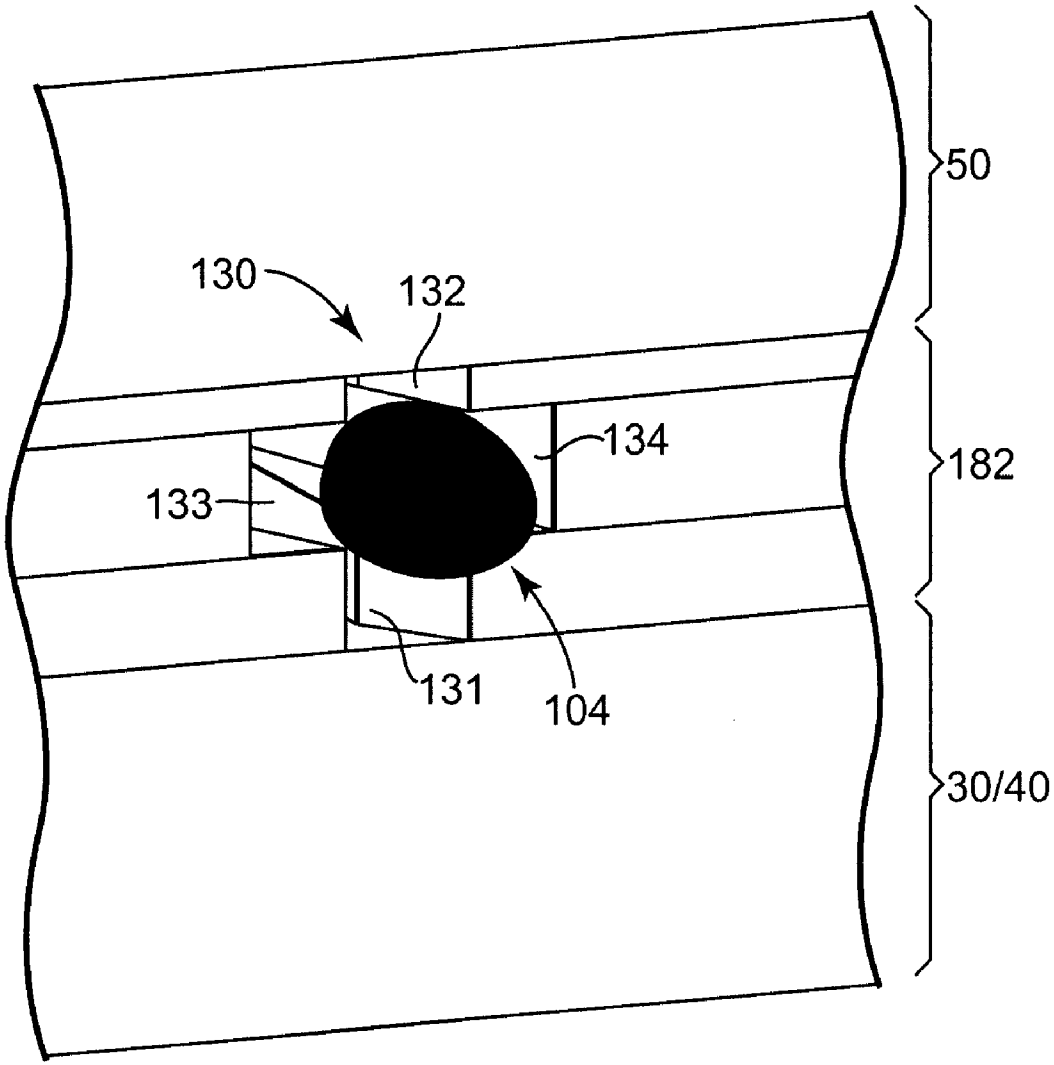
FIG. 10 is a schematic perspective view illustrating one embodiment of drop contact at the nozzle of FIG. 9.

As illustrated in the embodiments of FIGS. 9 and 10, by forming nozzle 130 with a cross-shaped cross-section, attachment or contact points 102 of a drop 104 ejected through nozzle 130 are spaced from and, more specifically, moved inwardly from outer layer 30 and/or 40 and inner layer 50 toward a center of nozzle 130. In one embodiment, for example, attachment or contact points 102 are defined at intersections of arms 131, 132, 133, and 134 of the cross-shaped cross-section of nozzle 130. As such, drop formation is decoupled from the edges of outer layer 30 and/or 40 and inner layer 50. Thus, by forming nozzles 130 with a cross-shaped cross-section, interaction with and potential wetting of perimeter walls of nozzles 130 is reduced thereby minimizing the possibility of puddling along the walls and possible misdirection of the drops. In addition, arms 131, 132, 133, and/or 134 of the cross-shaped cross-section of nozzles 130 provide paths or "gutters" for draining puddles of fluid (or ink) that do form near the surface of nozzles 130.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection assembly, comprising:

a first layer; and a second layer positioned on a side of the first layer, the second layer having a side adjacent the side of the first layer and an edge contiguous with the side thereof, and including a drop ejecting element formed on the side, a fluid pathway communicated with the drop ejecting element, and multi-layer barriers formed on opposite sides of the fluid pathway, wherein the first layer and the second layer form a nozzle, wherein the multi-layer barriers define a cross-shaped cross-section of the nozzle along the edge of the second layer, wherein each layer of the multi-layer barriers has an edge parallel with the edge of the second layer.

2. The fluid ejection assembly of claim 1, wherein the first layer has a fluid passage defined therein, wherein the fluid pathway of the second layer communicates with the fluid passage of the first layer.

3. The fluid ejection assembly of claim 1, wherein the drop ejecting element is adapted to eject drops of fluid through the nozzle substantially parallel to the side of the second layer.

4. The fluid ejection assembly of claim 1, wherein the fluid pathway of the second layer includes a fluid inlet, a fluid chamber communicated with the fluid inlet, and a fluid outlet communicated with the fluid chamber, and wherein the drop ejecting element of the second layer includes a firing resistor formed within the fluid chamber of the fluid pathway.

5. The fluid ejection assembly of claim 1, wherein the first layer and the second layer each include a common material, wherein the common material includes one of glass, a ceramic material, a carbon composite material, metal, and a metal matrix composite material.

6. The fluid ejection assembly of claim 1, wherein the multi-layer barriers are formed of one of a photo-imageable polymer, glass, and a deposited metal.

7. A fluid ejection assembly, comprising:

a first layer; and a second layer positioned on a side of the first layer, the second layer having a side adjacent the side of the first layer and an edge contiguous with the side thereof, and including a drop ejecting element formed on the side, a fluid pathway communicated with the drop ejecting element, and multi-layer barriers formed on opposite sides of the fluid pathway, wherein the first layer and the second layer form a nozzle, wherein the multi-layer barriers define a cross-shaped cross-section of the nozzle along the edge of the second layer, wherein a first dimension of the nozzle adjacent and parallel with the edge of the second layer and a second dimension of the nozzle adjacent and parallel with an edge of the first layer are each less than a third dimension of the nozzle intermediate of and parallel with the edge of the second layer and the edge of the first layer.

8. The fluid ejection assembly of claim 7, wherein the first, second, and third dimensions of the nozzle are each defined by different layers of the multi-layer barriers.

9. The fluid ejection assembly of claim 7, wherein the first layer has a fluid passage defined therein, wherein the fluid pathway of the second layer communicates with the fluid passage of the first layer.

10. The fluid ejection assembly of claim 7, wherein the drop ejecting element is adapted to eject drops of fluid through the nozzle substantially parallel to the side of the second layer.

11. The fluid ejection assembly of claim 7, wherein the fluid pathway of the second layer includes a fluid inlet, a fluid chamber communicated with the fluid inlet, and a fluid outlet communicated with the fluid chamber, and wherein the drop ejecting element of the second layer includes a firing resistor formed within the fluid chamber of the fluid pathway.

12. The fluid ejection assembly of claim 7, wherein the first layer and the second layer each include a common material, wherein the common material includes one of glass, a ceramic material, a carbon composite material, metal, and a metal matrix composite material.

13. The fluid ejection assembly of claim 7, wherein the multi-layer barriers are formed of one of a photo-imageable polymer, glass, and a deposited metal.

14. A fluid ejection assembly, comprising:

a first layer; and a second layer positioned on a side of the first layer, the second layer having a side adjacent the side of the first layer and an edge contiguous with the side thereof, and including a drop ejecting element formed on the side, a fluid pathway communicated with the drop ejecting element, and multi-layer barriers formed on opposite sides of the fluid pathway, wherein the first layer and the second layer form a nozzle, wherein the multi-layer barriers define a cross-shaped cross-section of the nozzle along the edge of the second layer, wherein each of the multi-layer barriers includes a first barrier layer adjacent the second layer, a second barrier layer adjacent the first layer, and a third barrier layer interposed between the first barrier layer and the second barrier layer, wherein a dimension of the first barrier layer along an edge parallel with the edge of the second layer and a dimension of the second barrier layer along an edge parallel with an edge of the first layer are each greater than a dimension of the third barrier layer along an edge parallel with the edge of the second layer and the edge of the first layer.

15. The fluid ejection assembly of claim 14, wherein a first arm of the cross-shaped cross-section of the nozzle is defined by the second layer and the first barrier layer, a second arm of the cross-shaped cross-section of the nozzle is defined by the first layer and the second barrier layer, and third and fourth arms of the cross-shaped cross-section of the nozzle are defined by the third barrier layer and the first and second barrier layers.

16. The fluid ejection assembly of claim 14, wherein the first layer has a fluid passage defined therein, wherein the fluid pathway of the second layer communicates with the fluid passage of the first layer.

17. The fluid ejection assembly of claim 14, wherein the drop ejecting element is adapted to eject drops of fluid through the nozzle substantially parallel to the side of the second layer.

18. The fluid ejection assembly of claim 14, wherein the fluid pathway of the second layer includes a fluid inlet, a fluid chamber communicated with the fluid inlet, and a fluid outlet communicated with the fluid chamber, and wherein the drop ejecting element of the second layer includes a firing resistor formed within the fluid chamber of the fluid pathway.

19. The fluid ejection assembly of claim 14, wherein the first layer and the second layer each include a common material, wherein the common material includes one of glass, a ceramic material, a carbon composite material, metal, and a metal matrix composite material.

20. The fluid ejection assembly of claim 14, wherein the multi-layer barriers are formed of one of a photo-imageable polymer, glass, and a deposited metal.

21. A method of forming a fluid ejection assembly, the method comprising:

forming a first layer;

forming a drop ejecting element on a side of a second layer;

forming a fluid pathway on the side of the second layer, including forming multi-layer barriers on the second layer on opposite sides of the fluid pathway and communicating the fluid pathway with the drop ejecting element; and positioning the second layer on a side of the first layer, including forming a nozzle with the first layer and the second layer, wherein the multi-layer barriers define a cross-shaped cross-section of the nozzle along an edge of the second layer contiguous with the side thereof, wherein each layer of the multi-layer barriers has an edge parallel with the edge of the second layer.

22. The method of claim 21, wherein forming the first layer includes defining a fluid passage in the first layer, and wherein positioning the second layer on the side of the first layer includes communicating the fluid pathway of the second layer with the fluid passage of the first layer.

23. The method of claim 21, wherein the drop ejecting element is adapted to eject drops of fluid through the nozzle substantially parallel to the side of the second layer.

24. The method of claim 21, wherein forming the fluid pathway includes forming a fluid inlet, communicating a fluid chamber with the fluid inlet, and communicating a fluid outlet with the fluid chamber, and wherein forming the drop ejecting element includes forming a firing resistor within the fluid chamber of the fluid pathway.

25. The method of claim 21, wherein the first layer and the second layer each include a common material, wherein the common material includes one of glass, a ceramic material, a carbon composite material, metal, and a metal matrix composite material.

26. The method of claim 21, wherein forming the nozzle includes forming the nozzle with a first dimension along the edge of the second layer, a second dimension along an edge of the first layer, and a third dimension intermediate of and parallel with the edge of the second layer and the edge of the first layer, wherein the first dimension and the second dimension are each less than the third dimension.

27. The method of claim 21, wherein the multi-layer barriers are formed of one of a photo-imageable polymer, glass, and a deposited metal.

28. The method of claim 21, wherein forming the multi-layer barriers includes forming each of the barriers with a first barrier layer, a second barrier layer, and a third barrier layer interposed between the first barrier layer and the second barrier layer, wherein the first barrier layer is adjacent the second layer, and wherein a dimension of the first barrier layer along the edge of the second layer and a dimension of the second barrier layer along an edge parallel with the edge of the second layer are each greater than a dimension of the third barrier layer along an edge parallel with the edge of the second layer.

29. A fluid ejection assembly, comprising:

a first layer having a side;

a second layer positioned on the side of the first layer and having a side facing the side of the first layer;

a fluid pathway formed on the side of the second layer;

multi-layer barriers formed on the side of the second layer on opposite sides of the fluid pathway;

a drop ejecting element communicated with the fluid pathway; and a nozzle communicated with the fluid pathway, wherein the multi-layer barriers define the fluid pathway and a cross-shaped cross-section of the nozzle along an edge of the second layer contiguous with the side thereof, wherein each layer of the multi-layer barriers has an edge parallel with the edge of the second layer, wherein the drop ejecting element is adapted to eject drops of fluid through the nozzle substantially parallel to the side of the second layer, wherein drop contact points at the nozzle are spaced from the side of the first layer and the side of the second layer.

30. The fluid ejection assembly of claim 29, wherein the first layer has a fluid passage defined therein, wherein the fluid pathway communicates with the fluid passage.

31. The fluid ejection assembly of claim 29, wherein the fluid pathway includes a fluid inlet, a fluid chamber communicated with the fluid inlet, and a fluid outlet communicated with the fluid chamber, wherein the nozzle communicates with the fluid outlet.

32. The fluid ejection assembly of claim 31, wherein the drop ejecting element includes a firing resistor formed on the side of the second layer within the fluid chamber of the fluid pathway.

33. The fluid ejection assembly of claim 29, wherein the first layer and the second layer each include a common material, wherein the common material includes one of glass, a ceramic material, a carbon composite material, metal, and a metal matrix composite material.

34. The fluid ejection assembly of claim 29, wherein a dimension of the nozzle along the edge of the second layer and a dimension of the nozzle along an edge of the first layer are each less than a dimension of the nozzle intermediate of and parallel with the edge of the second layer and the edge of the first layer.

35. The fluid ejection assembly of claim 29, wherein each of the multi-layer barriers includes a first barrier layer formed on the side of the second layer, a second barrier layer, and a third barrier layer interposed between the first barrier layer and the second barrier layer, wherein a dimension of the first barrier layer along an edge parallel with the edge of the second layer and a dimension of the second barrier layer along an edge parallel with the edge of the second layer are each greater than a dimension of the third barrier layer along an edge parallel with the edge of the second layer.

36. The fluid ejection assembly of claim 29, wherein the drop contact points are defined at intersections of arms of the cross-shaped cross-section of the nozzle.

37. The fluid ejection assembly of claim 29, wherein the multi-layer barriers are formed of one of a photo-imageable polymer, glass, and a deposited metal.

* * * * *